US008066484B1

(12) United States Patent
Liang

(10) Patent No.: US 8,066,484 B1
(45) Date of Patent: Nov. 29, 2011

(54) FILM COOLING HOLE FOR A TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1002 days.

(21) Appl. No.: 11/986,033

(22) Filed: Nov. 19, 2007

(51) Int. Cl.
*F01D 5/08* (2006.01)

(52) U.S. Cl. ..... 416/97 R; 415/115

(58) Field of Classification Search ..... 415/115, 415/116; 416/95, 96 R, 96 A, 97 R
See application file for complete search history.

(56) References Cited

U.S. PATENT DOCUMENTS

| | | | | |
|---|---|---|---|---|
| 4,653,983 | A | 3/1987 | Vehr | |
| 4,664,597 | A | 5/1987 | Auxier et al. | |
| 4,684,323 | A | 8/1987 | Field | |
| 4,705,455 | A | 11/1987 | Sahm et al. | |
| 4,738,588 | A | 4/1988 | Field | |
| 5,382,133 | A | 1/1995 | Moore et al. | |
| 6,183,199 | B1 | 2/2001 | Beeck et al. | |
| 6,243,948 | B1 | 6/2001 | Lee et al. | |
| 6,287,075 | B1 | 9/2001 | Kercher | |
| 6,368,060 | B1 | 4/2002 | Fehrenbach et al. | |
| 6,869,268 | B2 | 3/2005 | Liang | |
| 6,918,742 | B2 | 7/2005 | Liang | |
| 6,979,176 | B2 | 12/2005 | Nakamata et al. | |
| 7,246,992 | B2 | 7/2007 | Lee | |
| 7,374,401 | B2 * | 5/2008 | Lee | 416/97 R |
| 7,887,294 | B1 * | 2/2011 | Liang | 416/97 R |

* cited by examiner

*Primary Examiner* — Igor Kershteyn
(74) *Attorney, Agent, or Firm* — John Ryznic

(57) ABSTRACT

A film cooling hole for a turbine airfoil. the first embodiment is a film cooling hole aligned with the stream-wise direction of the hot gas flow over the hole and includes a metering section followed by a diffuser section. The diffuser section includes a left side wall and a right side wall both having a curvature facing outward and at about the same radius of curvature. The diffuser section also includes a top side wall and a bottom side wall which both have a curvature in the stream-wise direction, and in which the radius of curvature of the top side wall is greater than the radius of curvature of the bottom side wall. A second embodiment is a film cooling hole offset from the stream-wise direction of flow and includes the four walls with a curvature, but in which the left side wall has a greater radius of curvature than the right side wall due to the stream-wise offset of the hole.

18 Claims, 5 Drawing Sheets

Streamwise Hole

Radial Hole

Compound Angle Hole

FILM COOLING HOLE FOR A TURBINE AIRFOIL

BACKGROUND OF THE INVENTION

1. Field of the Invention

The present invention relates generally to air cooled turbine airfoils, and more specifically to a film cooling hole for the airfoils.

2. Description of the Related Art including information disclosed under 37 CFR 1.97 and 1.98

In a gas turbine engine, a turbine comprises a number of stages of stator vanes and rotor blades used to convert the energy from a hot gas flow into mechanical energy used to drive the rotor shaft. The efficiency of the engine can be increased by passing a higher temperature gas flow into the turbine. However, the highest temperature allowable is dependent on the material properties of the first stage airfoils (vanes and blades) and the amount of cooling provided. Once the material properties have been established, higher temperatures can be used if adequate cooling of the airfoils is provided.

Current airfoil cooling designs make use of internal convection and impingement cooling, and film cooling of the external airfoil surfaces that are exposed to the high temperature gas flow. Film cooling provides a blanket of cooling air over the airfoil surface that—in theory—prevents the hot gas flow from making contact with the airfoil surface. One major objective of a turbine airfoil designer is to maximize the effect of the cooling air while minimizing the usage of the cooling air in order to increase the efficiency of the engine, since the pressurized cooling air used for cooling the airfoils is bled of from the compressor of the engine. The bled off cooling air becomes wasted work.

Prior art film holes pass straight through the airfoil wall at a constant diameter and exit at an angle to the airfoil surface. Some of the cooling air is consequently ejected directly into the mainstream hot gas flow and causing turbulence, coolant dilution and a loss of downstream film effectiveness. Also, the hole breakout in the stream-wise elliptical shape will induce stress problems in a blade application. FIG. 1 summarizes this particular film hole design.

FIG. 2 shows a standard 10×10×10 stream-wise three dimension diffusion hole of the prior art. This type of film cooling hole comprises a constant cross section flow area at the entrance region for the purpose of metering the cooling flow. Downstream from the constant diameter section, the cooling hole is diffused into three directions. However, there is no diffusion in the upstream corner of the film cooling hole in the stream-wise direction as indicated by the top surface of the film hole in FIG. 2*b*. During engine operation, hot gas frequently becomes entrained into the upper corner (hot gas injection zone 12) and causes shear mixing with the cooling air. As a result, a reduction of film cooling effectiveness for the film hole occurs. In addition, internal flow separation 13 occurs within the diffusion hole at the junction between the constant cross section area and the diffusion region as shown in FIG. 3.

BRIEF SUMMARY OF THE INVENTION

The above described problems associated with turbine airfoil film cooling holes can be reduced by incorporating the film cooling hole geometry of the present invention into the prior art airfoil cooling design. The film hole of the present invention includes a curved diffusion hole in which each individual inner wall of the film hole is constructed with a various radius of curvature independent to each other. The unique film cooling hole design will allow for radial diffusion of the stream-wise oriented flow which combines the best aspects of both radial and stream-wise straight holes.

In one embodiment, the film hole is aligned with the stream-wise direction of the hot gas flow and the sides walls of the film hole have about the same amount of curvature. In a second embodiment, the film hole has side walls at different amounts of curvature to form a compound angle in which the stream-wise direction is not parallel to the film hole axis.

DETAILED DESCRIPTION OF THE INVENTION

The film cooling hole of the present invention is for use in an air cooled turbine airfoil such as a rotor blade or a stator vane of a gas turbine engine such as an industrial gas turbine (IGT) engine. However, the film cooling hole can be used in other devices in which film cooling of a surface is required in order to protect the surface from the effects of a high temperature gas flow passing over the surface. A combustor in a power plant or in a gas turbine engine requires film cooling and can make use of the film cooling hole of the present invention.

Figure 4A:
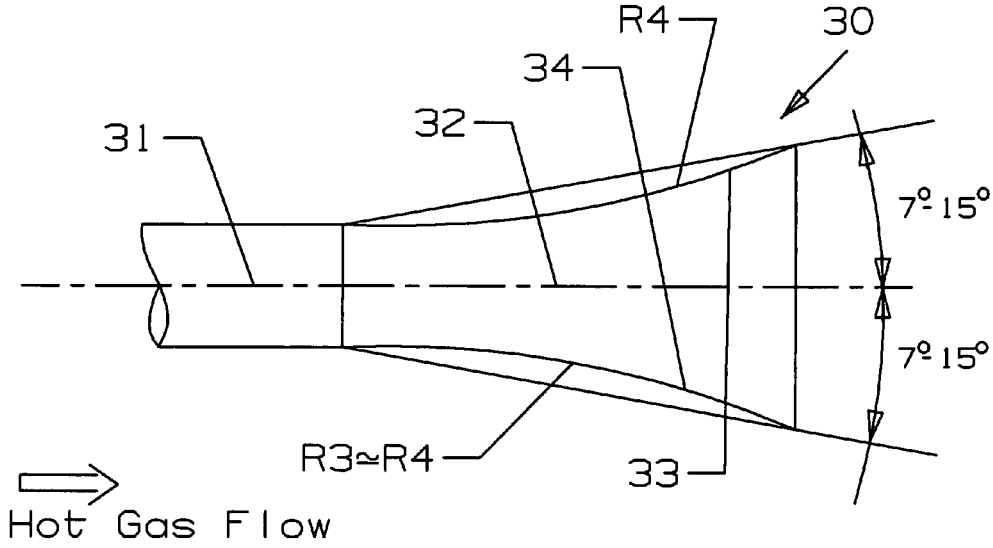
FIGS. 4*a* and 4*b* show the first embodiment of the film cooling hole of the present invention.
Figure 4B:
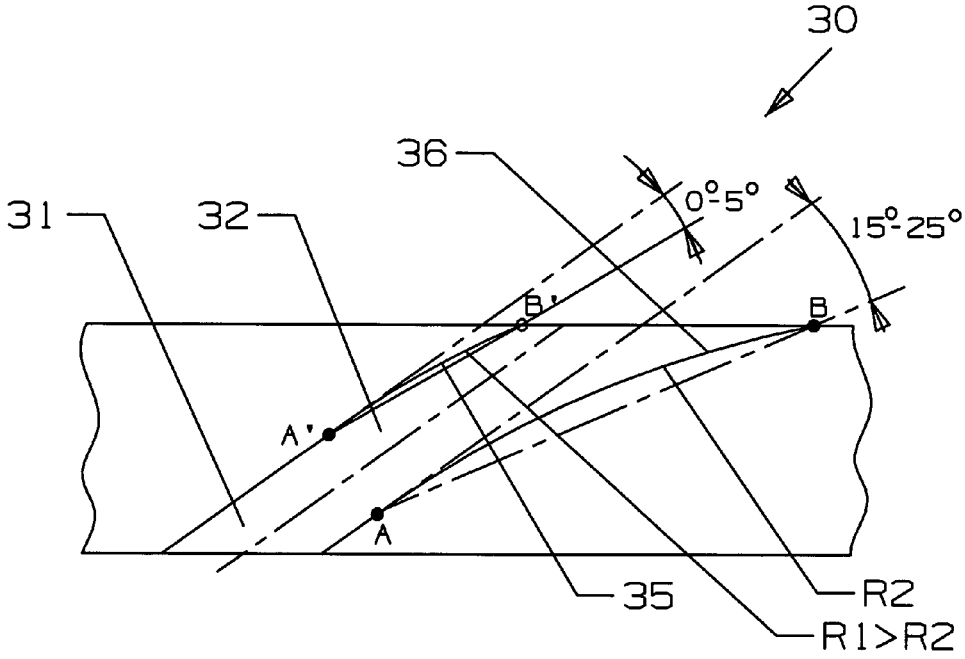

The first embodiment of the film cooling hole of the present invention is shown in FIGS. 4*a* and 4*b* where FIG. 4*a* shows a cross section view from the top of the film hole 30 and FIG. 4*b* shows a cross section side view with the top and bottom surfaces of the wall shown in the figure. The film cooling hole 30 includes a inlet section 31 of constant cross sectional area that functions as a metering hole for the film cooling hole 30, and includes a diffusion section 32 located downstream from the metering section 31. The axis of the film cooling hole 30 is shown in FIG. 4*a* in the dashed line. The two side walls of the film hole 30 include the left side wall 33 and the right side wall 34 and each have a curvature that faces outward as seen in FIG. 4*a*. The left side wall 33 has a curvature R4 and the right side wall 34 has a curvature R3 where the two curvatures R4 and R3 are about equal. The outlet ends of the two side walls 33 and 34 are in the range of 7-15 degrees offset from the film hole axis.

FIG. 4*b* shows the film hole from the cross sectional side view with the inlet metering section 31 and the diffusion section 32 and the film hole axis represented by the dashed line. The diffusion section 32 includes a top wall surface 35 and a bottom wall surface 36 with curvatures facing toward the bottom of this figure. The top wall 35 has a curvature of R1 and the bottom wall 36 has a curvature of R2 in which R1 is greater than R2. The outlet end of the top wall 35 has an angle of from 0-5 degrees offset from the film hole axis, while the outlet end of the bottom wall 36 forms an angle of 15-25 degrees. The hot gas flow for the film hole 30 of the first embodiment in FIG. 4 is shown by the large arrow and is parallel to the film hole axis.

In the first embodiment film hole 30, the side walls 33 and 34 have about the same radius of curvature (R3=R4) while the top side wall 35 has a radius of curvature R1 greater than the bottom side wall 36 radius of curvature R2.

Figure 5A:
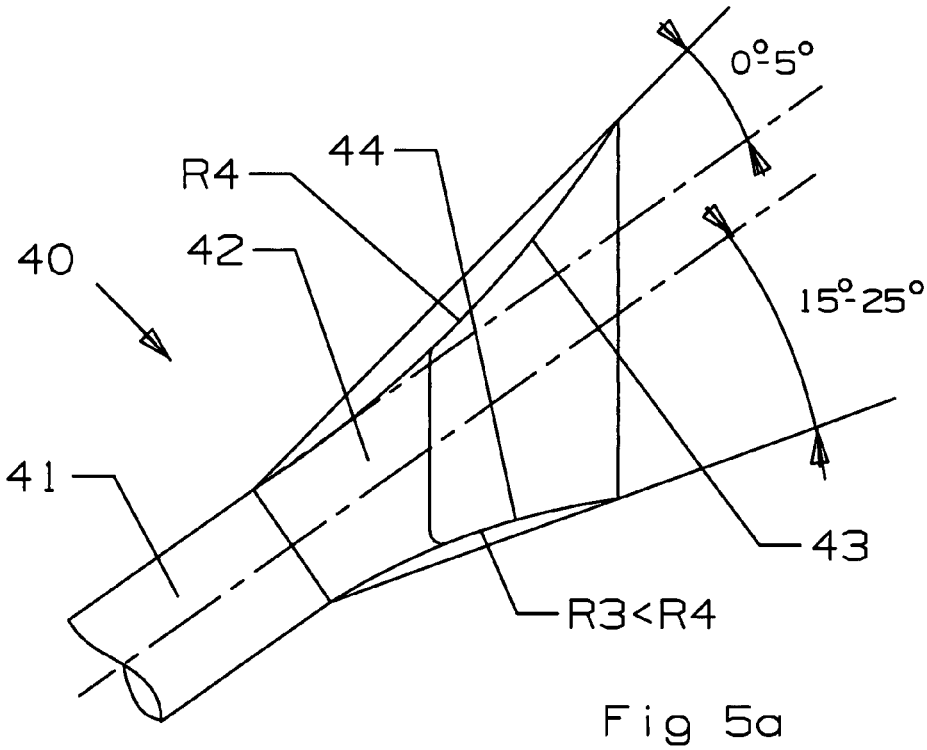
FIGS. 5*a* and 5*b* show the second embodiment of the film cooling hole of the present invention.
Figure 5B:
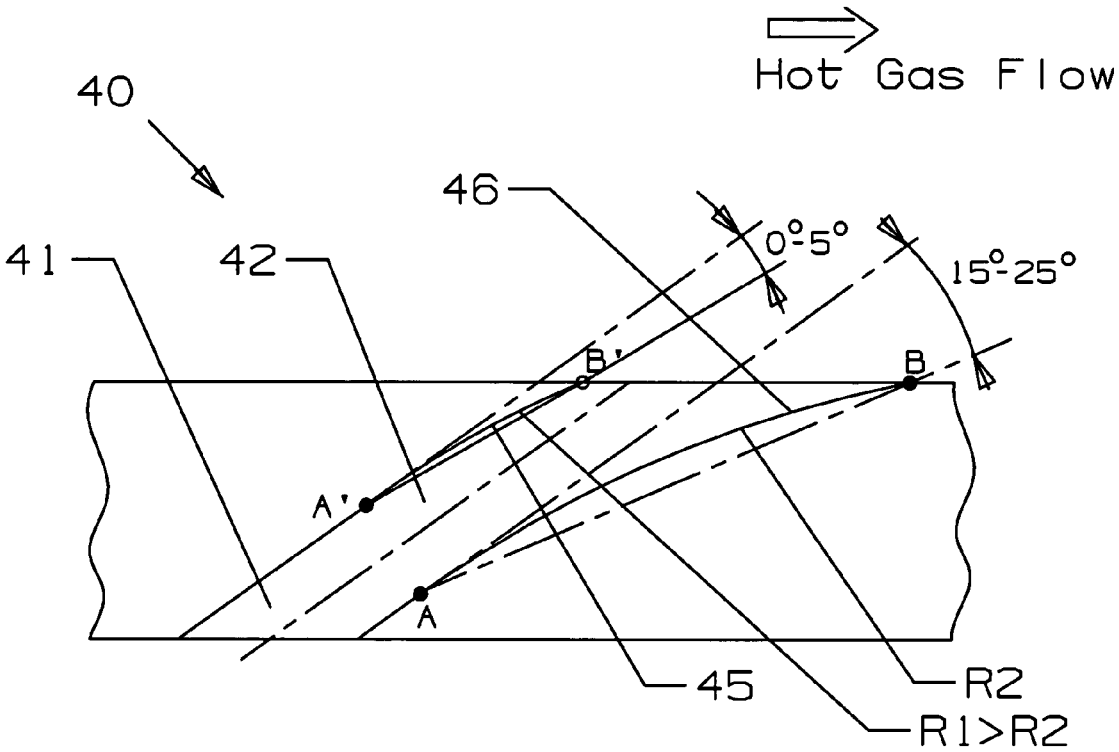

A second embodiment of the film cooling hole 40 is shown in FIGS. 5*a* and 5*b* and differs from the first embodiment in that the film cooling hole 40 is not aligned with the hot flow gas. The film hole 40 includes a metering section 41 of constant cross sectional area and a diffuser section 42. The diffuser section 42 includes a left side wall 43 and a right side wall 44 as seen in FIG. 5*a* in which the left side wall 43 is curved outward at 0-5 degrees from the metering hole axis represented by the dashed line. The right side wall 44 is curved outward at 15-25 degrees from the metering hole axis. The hot gas flow is represented by the large arrow between the two Figures and shows the film hole 40 axis offset at about 45 degrees from the hot gas flow.

The film hole 40 includes a top side wall 45 and a bottom side wall 46 as shown in FIG. 5*b* where the top side wall 45 is curved inward at 0-5 degrees and the bottom side wall is curved inward at 15-25 degrees. Both of these offset angles are measured from the metering hole axis and taken along a line from the points shown as A and B along the curved walls, where point A is at the beginning of the curved wall and pointBis at the end of the curved wall. In the second embodiment film hole 40, the left side wall 32 has a radius of curvature R4 greater than the radius of curvature R3 of the right side wall 44, while the top side wall 45 has a radius of curvature R1 greater than the bottom side wall 46 radius of curvature R2.

Figure 1A:
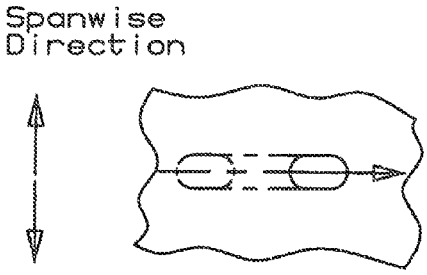
Fig 1a prior art
FIGS. 1*a* through 1*g* shows a prior art film cooling hole with a straight film cooling hole.
Figure 1B:
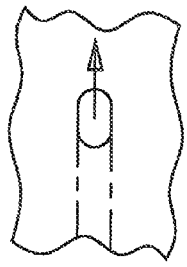
Fig 1b prior art
Figure 1C:
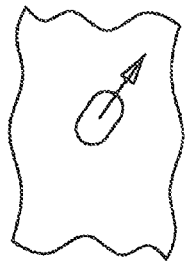
Fig 1c prior art
Figure 1D:
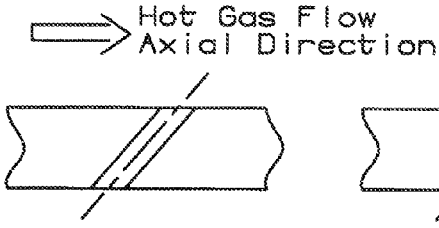
Fig 1d prior art
Figure 1E:
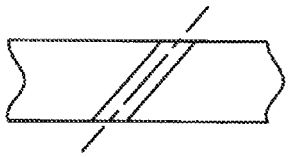
Fig 1e prior art
Figure 1F:
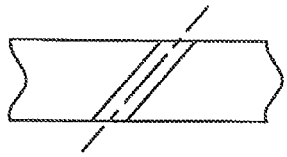
Fig 1f prior art
Figure 1G:
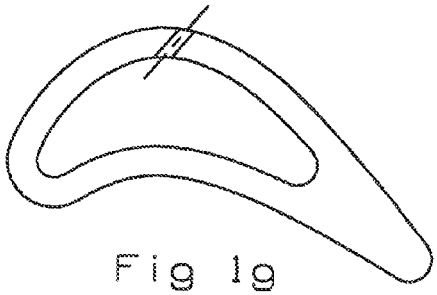
Fig 1g prior art
Figure 2A:
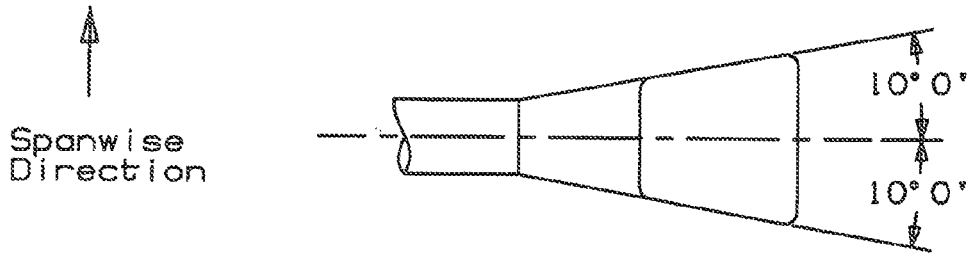
Fig 2a prior art
FIGS. 2*a* through 2*c* shows a prior art film cooling hole with diffusion along three sides of the hole.
Figure 2B:
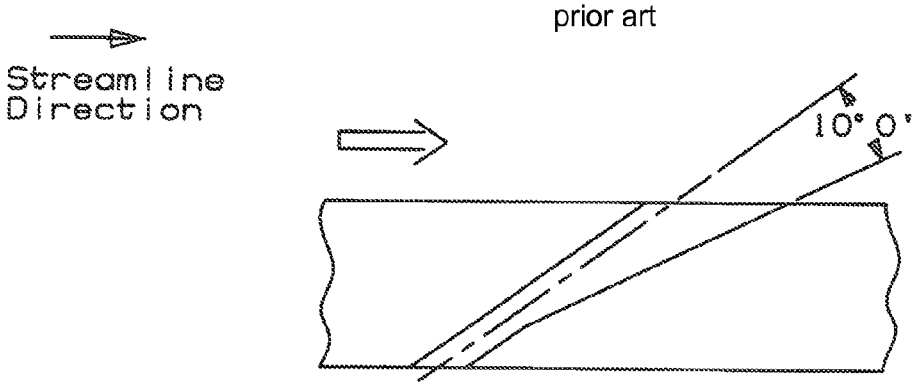
Fig 2b prior art
Figure 2C:
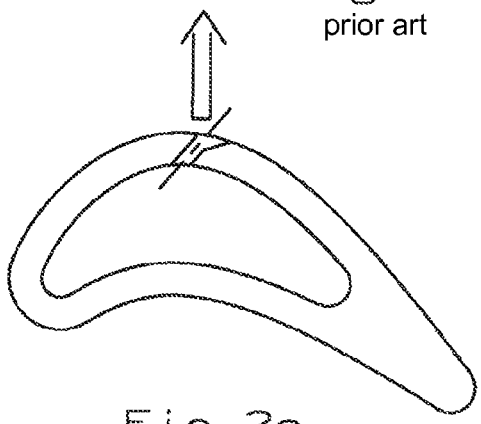
Fig 2c prior art
Figure 3:
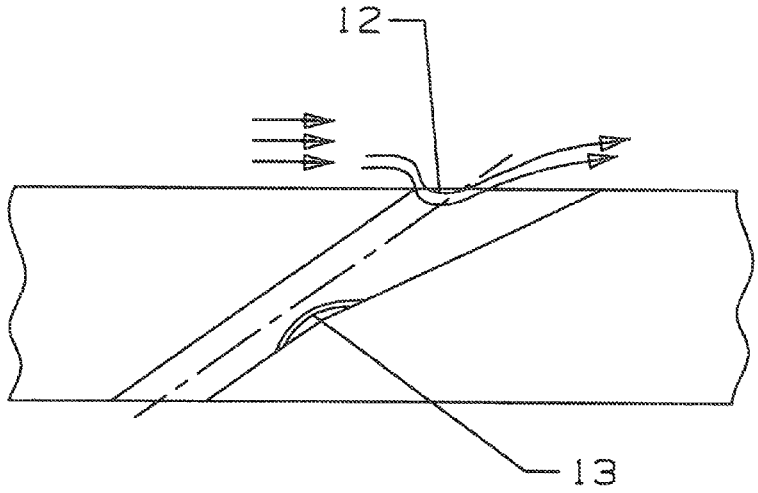
Fig 3 prior art
FIG. 3 shows the hot gas ingestion zone of the prior art film cooling hole of FIG. 2.

In the stream-wise direction, the curved wall at the upstream (35 in FIGS. 4*b* and 45 in FIG. 5*b*) of the film cooling hole has a larger radius of curvature than the downstream wall (36 in FIGS. 4*b* and 46 in FIG. 5*b*) which creates diffusion in the stream-wise flow direction. In addition, the curved wall in the upstream flow direction eliminates the hot gas entrainment problem identified in FIG. 3. The combined affects from both curved walls yields a diffusion film cooling hole with a much lower cooling injection angle. Thus, the shear mixing between the cooling layers versus the hot gas stream is minimized, resulting in a better film layer at a higher effective level. The curved surfaces for the upstream and downstream walls are formed with a continuous arc connecting the point at the end of the metering section and the intersection between the expansion surfaces to the airfoil external wall. the radius of curvature for both surfaces is determined with the continuous arc tangent to the points A or A' and cut through points B and B'. The upstream surface of the film cooling hole is not parallel to the center line of the film cooling hole and it has an angle between 0-5 degrees toward the airfoil trailing edge. The downstream surface for the film hole has an expansion between 15-25 degrees toward the airfoil trailing edge.

In the spanwise direction, the radial outward and radial inward film cooling hole walls (33 and 34 in FIG. 4*a*) can be curved at the same radius of curvature. This will increase the film hole breakout and yield a better film coverage in the spanwise direction. This cooling hole expansion of between 7-15 degrees is valid only if the hole is oriented in the stream-wise direction or at a small compound angle of less than 20 degrees. However, if the cooling hole is used in a highly radial direction oriented application (greater than 40 degrees from the axial flow direction of the hot gas stream) then the radial outward surface for the film cooling hole has to be at different radius of curvature than the radial inward surface. The radial outward surface will be at an expansion of less than 7 degrees. For this particular application, the radius of curvature for the inward wall can be much smaller than the outward surface (45 and 46 in FIG. 5*b*) and the expansion angle will be in-between 15-25 degrees which is larger than the 7-15 degrees as used for the (compound angled curved film hole) stream-wise angled film hole in FIG. 4. The end product of this differential yields a stream-wise oriented cooling flow injection flow phenomena for a compound angled film cooling hole with a much larger film coverage.

In summary, the various radius of curvature diffusion film hole has the expansion radial and rearward hole surfaces curved toward both the airfoil trailing edge and spanwise directions. Coolant penetration into the gas path is thus minimized, yielding good buildup of the coolant sub-boundary layer next to the airfoil surface, lower aerodynamic mixing losses due to low angle of cooling air injection, better film coverage in the spanwise direction and high film effectiveness for a longer distance downstream of the film hole. The end result of both benefits produces a better film cooling effectiveness level for the turbine airfoil.

I claim the following:

1. A film cooling hole for use in an air cooled turbine airfoil, the film cooling hole comprising:
- a metering section forming an inlet to the film cooling hole;
- a diffuser section downstream from the metering section;
- the diffuser section being formed with a left side wall and a right side wall, and a top side wall and a bottom side wall;
- the left side wall and the right side wall both having a radius of curvature in an outward direction; and,
- the top side wall and the bottom side wall both having a radius of curvature toward a stream-wise direction of the hot gas flow.

2. The film cooling hole of claim 1, and further comprising:
- the metering hole axis is aligned with the stream-wise direction of the hot gas flow; and,
- the radius of curvature of the left side wall and the right side wall is substantially equal.

3. The film cooling hole of claim 2, and further comprising:
- the radius of curvature of the top side wall is greater than the radius of curvature of the bottom side wall.

4. The film cooling hole of claim 3, and further comprising:
- the left side wall and the right side wall are offset from the metering hole axis in the range of from 7 degrees to 15 degrees.

5. The film cooling hole of claim 4, and further comprising:
- the top side wall is offset from the metering hole axis from zero to 5 degrees; and,
- the bottom side wall is offset from the metering hole axis from 15 to 25 degrees.

6. The film cooling hole of claim 1, and further comprising:
- the metering hole axis is significantly offset from the stream-wise direction of the hot gas flow; and,
- the radius of curvature of the left side wall is greater than the radius of curvature of the right side wall.

7. The film cooling hole of claim 6, and further comprising:
- the radius of curvature of the top side wall is greater than the radius of curvature of the bottom side wall.

8. The film cooling hole of claim 7, and further comprising:
- the left side wall is offset from the metering hole axis from zero to 5 degrees; and,
- the right side wall is offset from the metering hole axis from 15 degrees to 25 degrees.

9. The film cooling hole of claim 8, and further comprising:
- the top side wall is offset from the metering hole axis from zero to 5 degrees; and,
- the bottom side wall is offset from the metering hole axis from 15 to 25 degrees.

10. A turbine airfoil for use in a gas turbine engine, the airfoil comprising:

a pressure side wall and a suction side wall defining the airfoil surface;

an internal cooling circuit to provide cooling for the airfoil; and, a plurality of film cooling holes connected to the internal cooling circuit, the film cooling holes further comprising a metering section and a diffuser section, the diffuser section including a left side wall and a right side wall both with a curvature facing outward, the diffuser section including a top side wall and a bottom side wall both with a curvature facing toward the bottom of the diffuser.

11. The turbine airfoil of claim 10, and further comprising:

the metering hole axis is aligned with the stream-wise direction of the hot gas flow; and, the radius of curvature of the left side wall and the right side wall is substantially equal.

12. The film cooling hole of claim 11, and further comprising:

the radius of curvature of the top side wall is greater than the radius of curvature of the bottom side wall.

13. The film cooling hole of claim 12, and further comprising:

the left side wall and the right side wall are offset from the metering hole axis in the range of from 7 degrees to 15 degrees.

14. The film cooling hole of claim 13, and further comprising:

the top side wall is offset from the metering hole axis from zero to 5 degrees; and, the bottom side wall is offset from the metering hole axis from 15 to 25 degrees.

15. The film cooling hole of claim 10, and further comprising:

the metering hole axis is significantly offset from the stream-wise direction of the hot gas flow; and, the radius of curvature of the left side wall is greater than the radius of curvature of the right side wall.

16. The film cooling hole of claim 15, and further comprising:

the radius of curvature of the top side wall is greater than the radius of curvature of the bottom side wall.

17. The film cooling hole of claim 16, and further comprising:

the left side wall is offset from the metering hole axis from zero to 5 degrees; and, the right side wall is offset from the metering hole axis from 15 degrees to 25 degrees.

18. The film cooling hole of claim 17, and further comprising:

the top side wall is offset from the metering hole axis from zero to 5 degrees; and, the bottom side wall is offset from the metering hole axis from 15 to 25 degrees.

* * * * *